US006877468B2

(12) United States Patent
Tsujimura et al.

(10) Patent No.: US 6,877,468 B2
(45) Date of Patent: Apr. 12, 2005

(54) SYSTEM FOR CONTROLLING VALVE TIMING IN EVENT OF FAILURE

(75) Inventors: Tomohiro Tsujimura, Kariya (JP); Yasuo Hirata, Oobu (JP); Hideyuki Maeji, Okazaki (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/340,712

(22) Filed: Jan. 13, 2003

(65) Prior Publication Data

US 2003/0131814 A1 Jul. 17, 2003

(30) Foreign Application Priority Data

Jan. 15, 2002 (JP) ..... 2002-006463

(51) Int. Cl.[7] ..... F01L 1/34

(52) U.S. Cl. ..... 123/90.17; 123/90.15; 123/90.31

(58) Field of Search ..... 123/90.15, 90.17, 123/90.31

(56) References Cited

U.S. PATENT DOCUMENTS 6,301,543 B2 * 10/2001 Fujiwara et al. ..... 701/114
6,305,350 B1 * 10/2001 Livshiz et al. ..... 123/339.11
6,401,675 B1 * 6/2002 Nakamura et al. ..... 123/90.15

FOREIGN PATENT DOCUMENTS

| | | |
|---|---|---|
| JP | 58-158335 | 9/1983 |
| JP | 01-110844 | 4/1989 |
| JP | 10-121999 | 5/1998 |
| JP | 11-36907 | 2/1999 |

* cited by examiner

*Primary Examiner*—Thomas Denion
*Assistant Examiner*—Zelalem Eshete
(74) *Attorney, Agent, or Firm*—Nixon & Vanderhye P.C.

(57) ABSTRACT

A valve timing control apparatus for an internal combustion engine is provided which is designed to ensure the drivability of the engine in the event of failure in operation of a variable valve timing control system made up of intake and exhaust side variable valve timing control mechanisms. If one of intake and exhaust side variable valve timing control mechanism has failed, the control apparatus actuates the other variable valve timing control mechanism to control the timing of opening and closing of a corresponding one of intake and exhaust valves so as to decrease an amount of overlap between the opening and closing of the intake and exhaust valves.

4 Claims, 5 Drawing Sheets

FAILURE OF INTAKE SIDE

FAILURE OF EXHAUST SIDE

SYSTEM FOR CONTROLLING VALVE TIMING IN EVENT OF FAILURE

BACKGROUND OF THE INVENTION

1. Technical Field of the Invention

The present invention relates generally to a valve timing control system for internal combustion engines which is so designed as to control the timing of opening and closing of intake or exhaust valves to improve drivability of the engine in the event of failure of one of intake or exhaust valve timing control mechanisms.

2. Background Art

In recent years, automotive internal combustion engines equipped with variable valve timing control mechanisms working to vary the timing of opening and closing of intake and exhaust valves have increased in order to improve engine output, fuel economy, and exhaust emissions.

Japanese Patent First Publication No. 10-121999 discloses an automotive valve timing control device for internal combustion engines equipped with two variable valve timing control mechanisms one for each of two cylinder groups. If one of the variable valve timing control mechanisms has failed, the valve timing control device works to control the other variable valve timing control device to decrease the amount of overlap between the opening and closing of inlet and exhaust valves of a corresponding one of the cylinder groups.

Specifically, the valve timing control device works to decrease the amount of overlap of the intake and exhaust valves of one of the cylinder groups operating normally to secure the stability of burning of the engine. It is, however, impossible to change the amount of overlap of the intake and exhaust valves of the cylinder group which is malfunctioning, which may cause the amount of EGR (exhaust gas recirculation) to be increased in some engine operating range, thus resulting in instability of engine combustion. Specifically, one of the cylinder groups which is in service is stable in combustion, while the other cylinder group which is out of service is still instable in combustion, thus resulting in a variation in output torque of the engine.

SUMMARY OF THE INVENTION

It is therefore a principal object of the invention to avoid the disadvantages of the prior art.

It is another object of the invention to provide a valve timing control system for internal combustion engines which is designed to assure stability of combustion in a malfunctioning cylinder group as well as a cylinder group operating normally.

According to one aspect of the invention, there is provided a valve timing control apparatus for an internal combustion engine which is designed to ensure the drivability of the engine in the event of failure of a valve timing control system. The control apparatus comprises: (a) an intake side variable valve timing control mechanism installed in a driving force transmission system working to transmit a driving force outputted from a drive shaft of an internal combustion engine to a driven shaft working to open and close an intake valve of the engine, the intake side variable valve timing control mechanism being so designed as to control timing of opening and closing of the intake valve variably; (a) an exhaust side variable valve timing control mechanism installed in a driving force transmission system working to transmit the driving force outputted from the drive shaft of the engine to a driven shaft working to open and close an exhaust valve of the engine, the exhaust side variable valve timing control mechanism being so designed as to control timing of opening and closing of the exhaust valve variably; and (c) a controller working to detect a failure in operation of each of the intake side variable valve timing control mechanism and the exhaust side variable valve timing control mechanism. If the failure of one of the intake side variable valve timing control mechanism and the exhaust side variable valve timing control mechanism is detected, the controller actuates the other of the intake side variable valve timing control mechanism and the exhaust side variable valve timing control mechanism to control the timing of opening and closing of a corresponding one of the intake and exhaust valves so as to decrease an amount of overlap between the opening and closing of the intake and exhaust valves. This improves the drivability of the vehicle, especially in a low speed range of the engine.

In the preferred mode of the invention, if the failure of one of the intake side variable valve timing control mechanism and the exhaust side variable valve timing control mechanism is detected, the controller minimizes the amount of overlap between the opening and closing of the intake and exhaust valves.

If the failure of one of the intake side variable valve timing control mechanism and the exhaust side variable valve timing control mechanism is detected, the controller may also work to increase an idle speed of the engine more than usual, thereby avoiding rough idling of the engine.

According to the second aspect of the invention, there is provided a valve timing control apparatus for an internal combustion engine which comprises: (a) an intake side variable valve timing control mechanism installed in a driving force transmission system working to transmit a driving force outputted from a drive shaft of an internal combustion engine to a driven shaft working to open and close an intake valve of the engine, the intake side variable valve timing control mechanism being so designed as to control timing of opening and closing of the intake valve variably; (b) an exhaust side variable valve timing control mechanism installed in a driving force transmission system working to transmit the driving force outputted from the drive shaft of the engine to a driven shaft working to open and close an exhaust valve of the engine, the exhaust side variable valve timing control mechanism being so designed as to control timing of opening and closing of the exhaust valve variably; and (c) a controller working to detect a failure in operation of each of the intake side variable valve timing control mechanism and the exhaust side variable valve timing control mechanism. If the failure of either one of the intake side variable valve timing control mechanism and the exhaust side variable valve timing control mechanism is detected, the controller increase an idle speed of the engine. This avoids rough idling of the engine, thus improving the drivability of the engine, especially in a low speed range.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings:

FIG. 7(*b*) is a time chart which shows a change in amount of overlap between opening and closing of intake and exhaust valves made in the event of failure of an exhaust side variable cam timing control mechanism.

DESCRIPTION OF THE PREFERRED EMBODIMENTS

Figure 1:
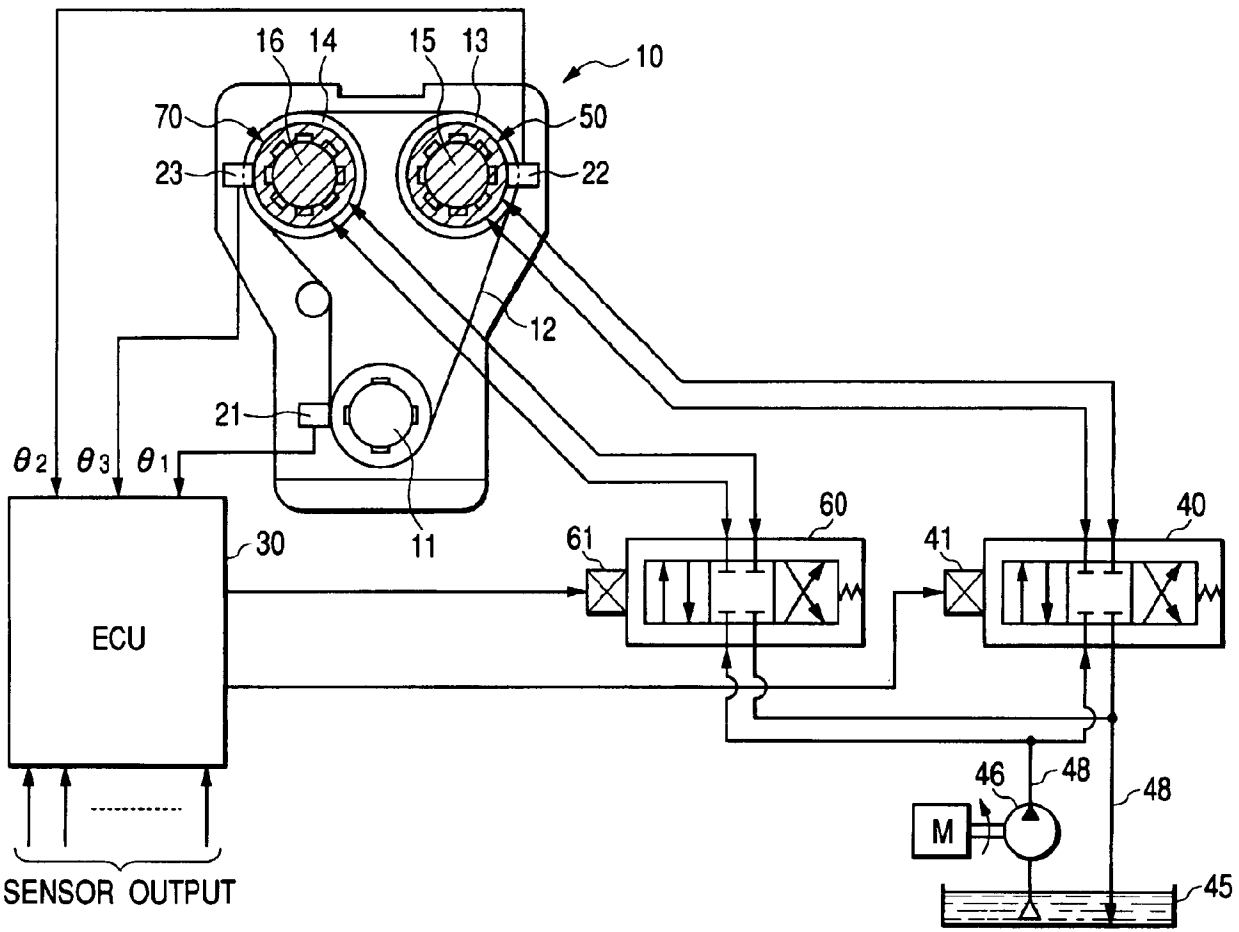
FIG. 1 is a block diagram which shows a valve timing control device installed in an automotive internal combustion engine according to the invention.

Referring to the drawings, particularly to FIG. 1, there is shown a valve timing control device which is installed, as an example, in an automotive four-cylinder in-line internal combustion engine 10 equipped with double overhead cam shafts.

The engine 10 produces and transmits torque to an intake side chain sprocket 13 and an exhaust side chain sprocket 14 through a crankshaft 11 and a chain 12. The chain sprockets 13 and 14 rotate in synchronization with the crankshaft 11 and have an intake cam shaft 15 and an exhaust cam shaft 16 joined thereto. The intake cam shaft 15 rotates to open and close intake valves (not shown) of the engine 10 cyclically. Similarly, the exhaust cam shaft 16 rotate to open or close exhaust valves (not shown) of the engine 10 cyclically. This structure is well known in the art, and explanation thereof in detail will be omitted here.

The crankshaft 11 is equipped with a crank position sensor 21 which works to produce a pulse signal θ1 cyclically. The intake cam shaft 15 is equipped with an intake cam position sensor 22 which works to produce a pulse signal θ2 cyclically. The exhaust cam shaft 16 is equipped with an exhaust cam position sensor 23 which works to produce a pulse signal θ3 cyclically. The pulse signals θ1, θ2, and θ3 are inputted to an ECU (electronic control unit) 30.

The ECU 30 is made of an arithmetic logic unit consisting of a CPU, a ROM in which control programs are stored, a RAM in which data are stored, a backup RAM, input and output circuits and a bus line.

The ECU 30 also receives sensor signals indicative of the amount of intake air per unit engine speed outputted from an airflow meter (not shown) used as representing an engine operating condition, the position of a throttle valve outputted from a throttle position sensor (not shown), and the temperature of a cooling water outputted from a water temperature sensor (not shown).

The ECU 30 determines the speed of the engine 10 using the pulse signals θ1 produced by the crank position sensor 21, an actual phase VTin of the intake cam shaft 15 relative to the crankshaft 11 using the pulse signals θ2 outputted from the intake cam position sensor 22, and an actual phase VTex of the exhaust cam shaft 16 relative to the crankshaft 11 using the pulse signals θ3 outputted from the exhaust cam position sensor 23. The ECU 30 also determines a target phase TVTin of the intake cam shaft 15 and a target phase TVTex of the exhaust cam shaft 16 according to an operating condition of the engine 10.

The ECU 30 outputs a duty cycle-controlled signal to a linear solenoid 41 of an intake spool valve 40 working as an OCV (oil-flow control valve) and feeds oil stored in an oil tank 45 to an intake side variable cam timing control mechanism 50, as illustrated by hatched lines in FIG. 1, (will also be referred to as an IN-VCT below) through a pump 46 and an oil supply line 47. The IN-VCT 50 is installed on the intake cam shaft 15 in a torque transmission system transmitting the torque outputted from the crankshaft 10 to the intake cam shaft 15 and works to change the timing of opening and closing of the intake valves hydraulically. Similarly, the ECU 30 also outputs a duty cycle-controlled signal to a linear solenoid 61 of an exhaust spool valve 60 and feeds the oil from the oil tank 45 to an exhaust side variable cam timing control mechanism 70, as illustrated by hatched lines in FIG. 1, (will also be referred to as an EX-VCT below) through the pump 46 and the oil supply line 47. The IN-VCT 50 is installed on the exhaust cam shaft 16 in the torque transmission system and works to change the timing of opening and closing of the exhaust valves hydraulically.

Specifically, the ECU 30 controls the amount of the oil supplied to the IN-VCT 50 and the EX-VCT 70 independently to bring the phases VTin and VTex of the intake cam shaft 15 and the exhaust cam shaft 16 into agreement with the target phases TVTin and TVTex, respectively, and allows the intake cam shaft 15 and the exhaust cam shaft 16 to rotate at fixed phase angles to the chain sprockets 13 and 14 or the crankshaft 11. The oil supplied to the IN=VCT 50 and EX-VCT 70 are drained and returned back to the oil tank 45 through a drain line 48.

The crank position sensor 21 outputs N pulses (i.e., the pulse signals θ1) during one revolution of the crankshaft 11. The intake cam position sensor 22 outputs N pulses (i.e., the pulse signals θ2) during one revolution of the intake cam shaft 15. Similarly, the exhaust cam position sensor 23 outputs N pulses (i.e., the pulse signals θ3) during one revolution of the exhaust cam shaft 16. If a maximum possible change in angular position of the intake cam shaft 15 and the exhaust cam shaft 16 is defined as θ max (° CA (crank angle)), the pulse number N is determined to meet a relation of $N<(360/\theta\ \max)$, thereby enabling the actual phases VTin and VTex of the intake cam shaft 15 and the exhaust cam shaft 16 to be determined using the pulse signals θ1 produced by the crank position sensor 21 and the pulse signals θ2 and θ3 outputted by the intake cam position sensor 22 and the exhaust cam position sensor 23 following the pulse signal θ1.

Specifically, the ECU 30 calculates an actual phase difference (=θ1−θ2) between the intake cam shaft 15 and the crankshaft 11 using the pulse signals θ1 and θ2 outputted from the crank position sensor 21 and the intake cam position sensor 22 and determines the phase VTin of the intake cam shaft 15 as a function of a difference between the actual phase difference and a reference value as expressed by an angle (° CA) advanced from the reference value. The reference value is defined by a phase difference between the intake cam shaft 15 and the crankshaft 11 learned under maximum retarded angle control wherein the intake cam shaft 15 is brought to the most retarded angular position. Additionally, the ECU 30 also calculates an actual phase difference (=θ1−θ3) between the exhaust cam shaft 16 and the crankshaft 11 using the pulse signals θ1 and θ3 outputted from the crank position sensor 21 and the exhaust cam position sensor 23 and determines the phase VTex of the exhaust cam shaft 16 as a function of a difference between the actual phase difference and a reference value as expressed by an angle (° CA) advanced from the reference value. The reference value is defined by a phase difference between the exhaust cam shaft 16 and the crankshaft 11 learned under the maximum retarded angle control.

Figure 2:
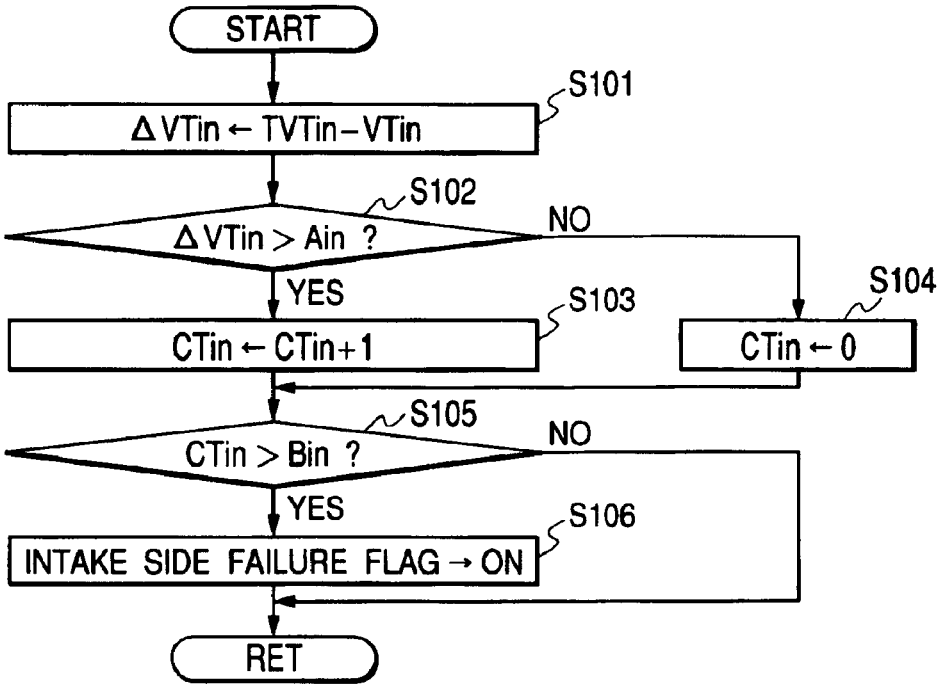
FIG. 2 is a flowchart of a program executed to determine whether an intake side variable cam timing control mechanism has failed or not.

FIG. 2 is a flowchart of a program executed by the ECU 30 in a cycle to detect locking of the IN-VCT 50. The locking of the IN-VCT 50, as referred to herein, means a failure in operation of the IN-VCT 50 caused by intrusion of foreign matter into an oil supply system of the IN-VCT 50. The program of FIG. 2 will be described below with reference a time chart of FIG. 6.

After entering the program of FIG. 2, the routine proceeds to step 101 wherein the intake cam shaft phase VTin is subtracted form the target intake cam shaft phase TVTin to determine a phase difference ΔVTin therebetween. The routine proceeds to step 102 wherein it is determined whether the phase difference ΔVTin derived in step 101 is greater than a given value Ain or not. If a YES answer is obtained meaning that the phase difference ΔVTin is greater than the given value Ain, then the routine proceeds to step 103 wherein a value CTin of a time counter is incremented by one (1) (between time t0 and t1 in FIG. 6).

Alternatively, if a NO answer is obtained in step 102, then the routine proceeds to step 104 wherein the counter value CTin is cleared to zero (0). After step 103 or 104, the routine proceeds to step 105 wherein it is determined whether the counter value CTin is greater than a given value Bin or not. If a YES answer is obtained meaning that the counter value CTin is greater than the given value Bin, that is, that the phase difference ΔVTin, as determined in step 101, continues to be greater than the given value Ain for a long period of time, then the routine proceeds to step 106 wherein the ECU 30 determines that the IN-VCT 50 has locked and sets an intake side failure flag to an on-state (time t1 in FIG. 6). The routine then terminates.

Alternatively, if a NO is obtained in step 105 meaning that the phase difference ΔVTin, as determined in step 101, continues to be smaller than the given value Ain for a long period of time, then the routine terminals while keeping the intake side failure flag in an off-state indicating that the IN-VCT 50 is in service.

Figure 3:
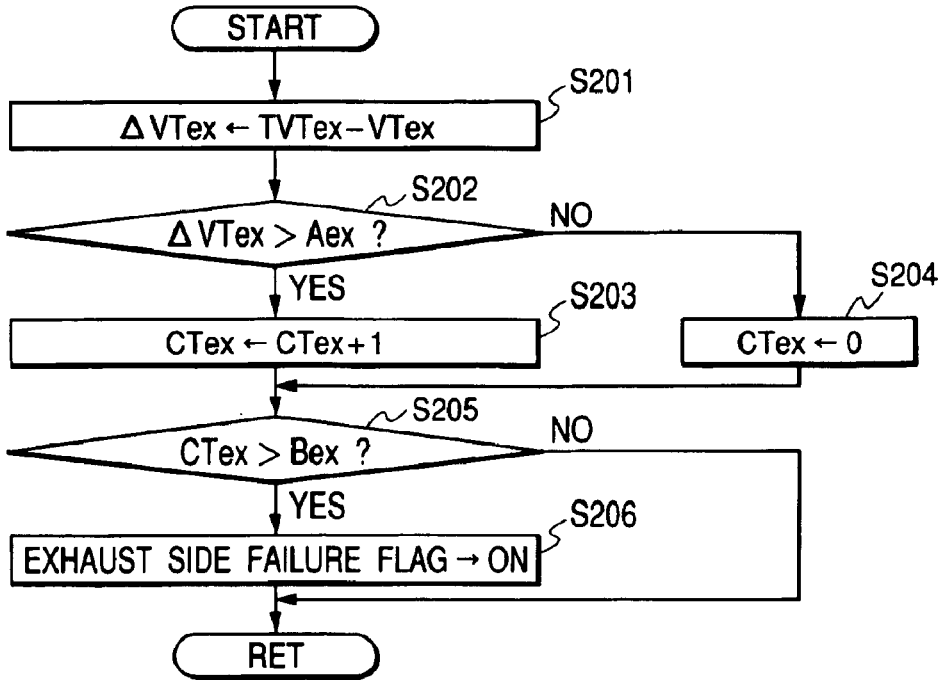
FIG. 3 is a flowchart of a program executed to determine whether an exhaust side variable cam timing control mechanism has failed or not.

FIG. 3 shows a flowchart of a program executed by the ECU 30 in a cycle to detect locking of the EX-VCT 70. The locking of the EX-VCT 70 means, like the IN-VCT 50, a failure in operation of the EX-VCT 70 caused by intrusion of foreign matter into an oil supply system of the EX-VCT 70.

After entering the program, the routine proceeds to step 201 wherein the exhaust cam shaft phase VTex is subtracted form the target exhaust cam shaft phase TVTex to determine a phase difference ΔVTex therebetween. The routine proceeds to step 202 wherein it is determined whether the phase difference ΔVTex derived in step 101 is greater than a given value Aex or not. If a YES answer is obtained meaning that the phase difference ΔVTex is greater than the given value Aex, then the routine proceeds to step 203 wherein a value CTex of a time counter is incremented by one (1).

Alternatively, if a NO answer is obtained in step 202, then the routine proceeds to step 204 wherein the counter value CTex is cleared to zero (0). After step 203 or 204, the routine proceeds to step 205 wherein it is determined whether the counter value CTex is greater than a given value Bex or not. If a YES answer is obtained meaning that the counter value CTex is greater than the given value Bex, that is, that the phase difference ΔVTex, as determined in step 201, continues to be greater than the given value Aex for a long period of time, then the routine proceeds to step 206 wherein the ECU 30 determines that the EX-VCT 70 has locked and sets an exhaust side failure flag to the on-state. The routine then terminates.

Alternatively, if a NO is obtained in step 205 meaning that the phase difference ΔVTex, as determined in step 201, continues to be smaller than the given value Aex for a long period of time, then the routine terminals while keeping the exhaust side failure flag in an off-state indicating that the EX-VCT 70 is in service.

Figure 4:
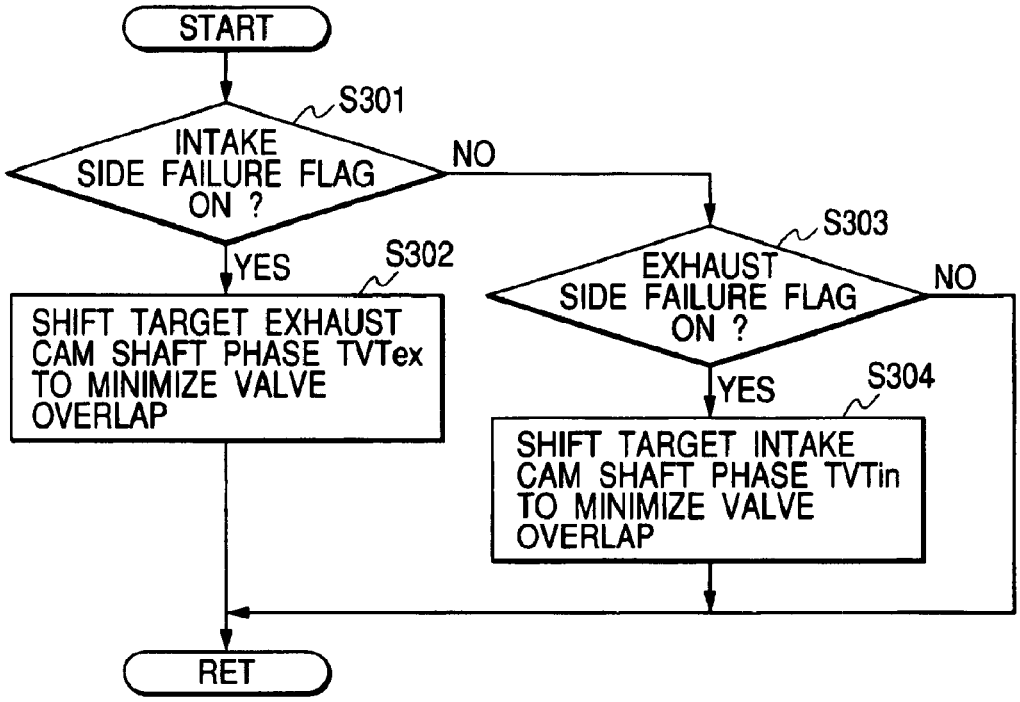
FIG. 4 is a flowchart of a program executed to decrease the amount of overlap between opening and closing of intake and exhaust valves in the even of failure of one of intake and exhaust variable cam timing control mechanisms.
Figure 6:
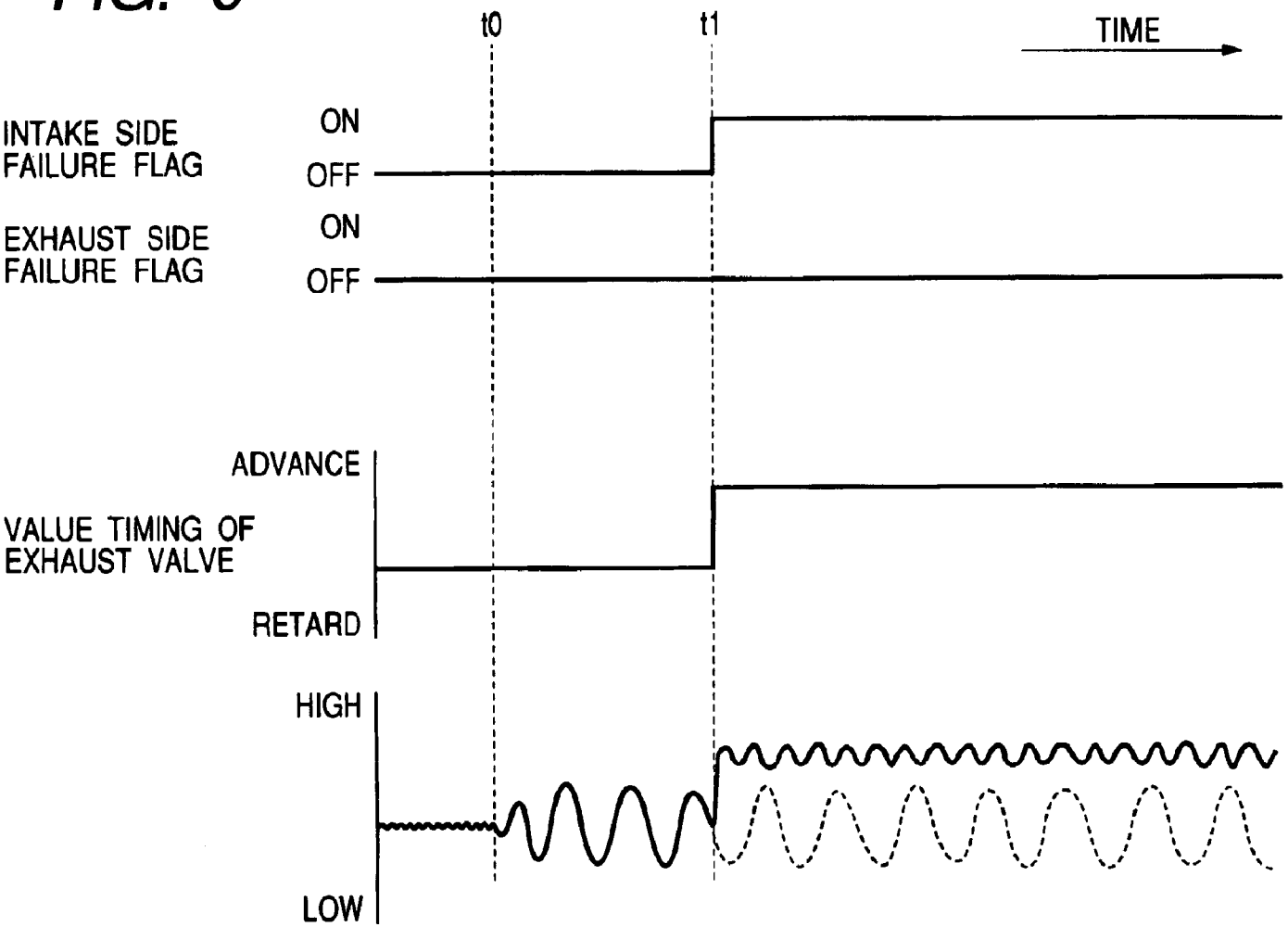
FIG. 6 is a time chart which shows a change in opening and closing timing of exhaust valves made in the program of FIG. 4 and a change in idle speed of an engine made in the program of FIG. 5.
Figure 7A:
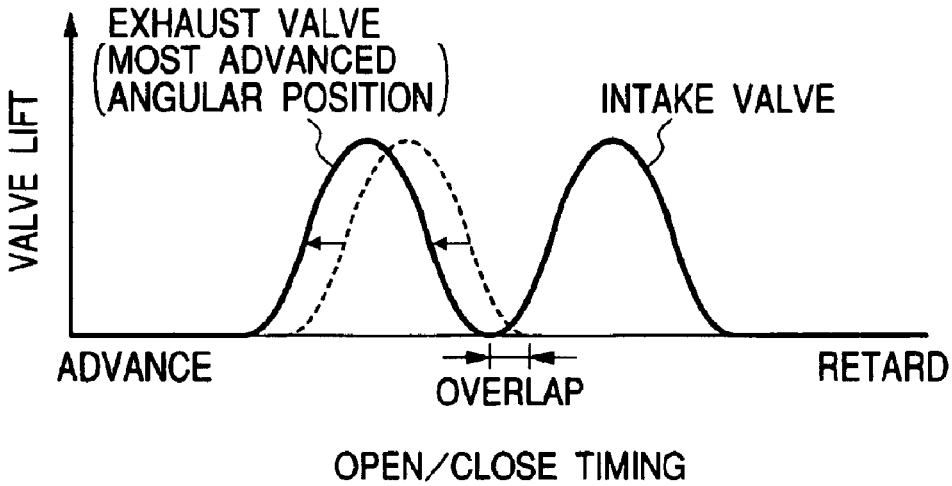
FIG. 7(*a*) is a time chart which shows a change in amount of overlap between opening and closing of intake and exhaust valves made in the event of failure of an intake side variable cam timing control mechanism.
Figure 7B:
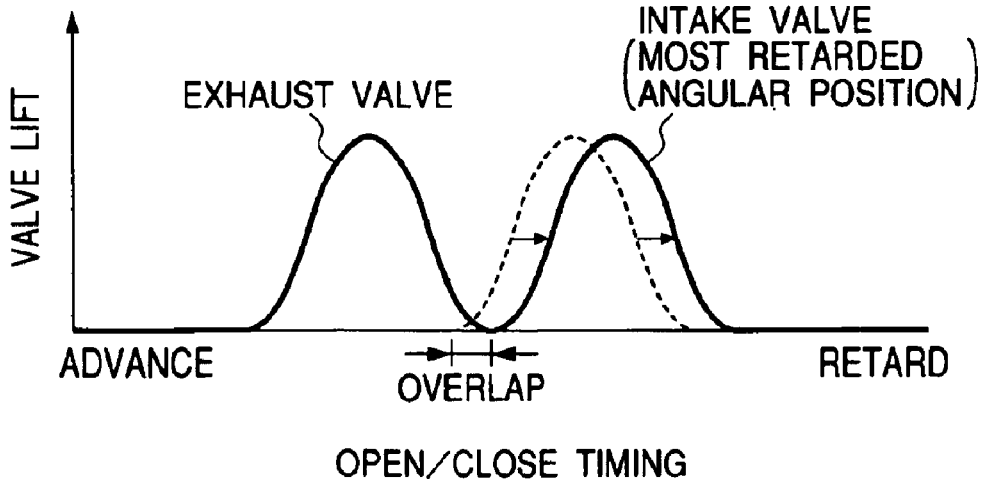

An operation of the valve timing control device which is performed in the event of failure of the IN-VCT 50 will be described below with reference to FIGS. 4, 6, 7(*a*), and 7(*b*). FIG. 4 shows a valve timing control program executed by the ECU 30 cyclically. FIG. 7(*a*) illustrates a change in amount of overlap between the opening and closing of the intake and exhaust valves of the engine 10 in terms of parameters indicating the amount of lift of and the timing of opening and closing of the intake and exhaust valves in the event of failure of the IN-VCT 50. FIG. 7(*b*) illustrates a change in amount of overlap between the opening and closing of the intake and exhaust valves of the engine 10 in terms of parameters indicating the amount of lift of and the timing of opening and closing of the intake and exhaust valves in the event of failure of the EX-VCT 70.

After entering the program of FIG. 4, the routine proceeds to step 301 wherein it is determined whether the intake side failure flag, as provided in step 106 of FIG. 2, is in the on-state or not. If a YES answer is obtained meaning that the IN-VCT 50 has failed, so that the intake side failure flag is set to the on-state at time t1 in FIG. 6, then the routine proceeds to step 302 wherein the target exhaust cam shaft phase TVTex provided for the EX-VCT 70 operating normally is determined and fixed so as to minimize the amount of overlap of the intake and exhaust valves. Specifically, the target exhaust cam shaft phase TVTex is determined, as can be seen in FIG. 7(*a*), so as to shift the opening and closing timing of the exhaust valves (i.e., the angle at which the exhaust valves are to be opened or closed) toward a maximum advanced angle. After step 302, the routine terminates.

Alternatively, if a NO answer is obtained in step 301 meaning that the IN-VCT 50 is in service, then the routine proceeds to step 303 wherein it is determined whether the exhaust side failure flag, as provided in step 206 of FIG. 3, is in the on-state or not. If a YES answer is obtained meaning that the EX-VCT 70 has failed, so that the exhaust side failure flag is set to the on-state, then the routine proceeds to step 304 wherein the target intake cam shaft phase TVTin provided for the IN-VCT 50 operating normally is determined and fixed so as to minimize the amount of overlap of the intake and exhaust valves. Specifically, the target intake cam shaft phase TVTin is determined, as can be seen in FIG. 7(*b*), so as to shift the opening and closing timing of the intake valves (i.e., the angle at which the intake valves are to be opened or closed) toward a maximum retarded angle. After step 304 or if a NO answer is obtained in step 303, the routine terminates.

As apparent from the above discussion, if a failure of one of the IN-VCT 50 and the EX-VCT 70 has been detected, the valve timing control device of this embodiment actuates the other of the IN-VCT 50 and the EX-VCT 70 which is operating normally to minimize the amount of overlap between opening and closing durations of the intake and exhaust valves. For instance, if the IN-VCT 50 has locked, the valve timing control device actuates the EX-VCT 70 to shift the opening and closing angular positions of the exhaust valves to the most advanced angular position and keeps it. Conversely, if the EX-VCT 70 has locked, the valve timing control devices actuates the IN-VCT 50 to shift the opening and closing angular positions of the intake valves to the most retarded angular position and keeps it. This results in a decreased amount of overlap between the opening and closing of the intake and exhaust valves, thereby improving the drivability of the vehicle, especially in a low speed range of the engine 10.

Figure 5:
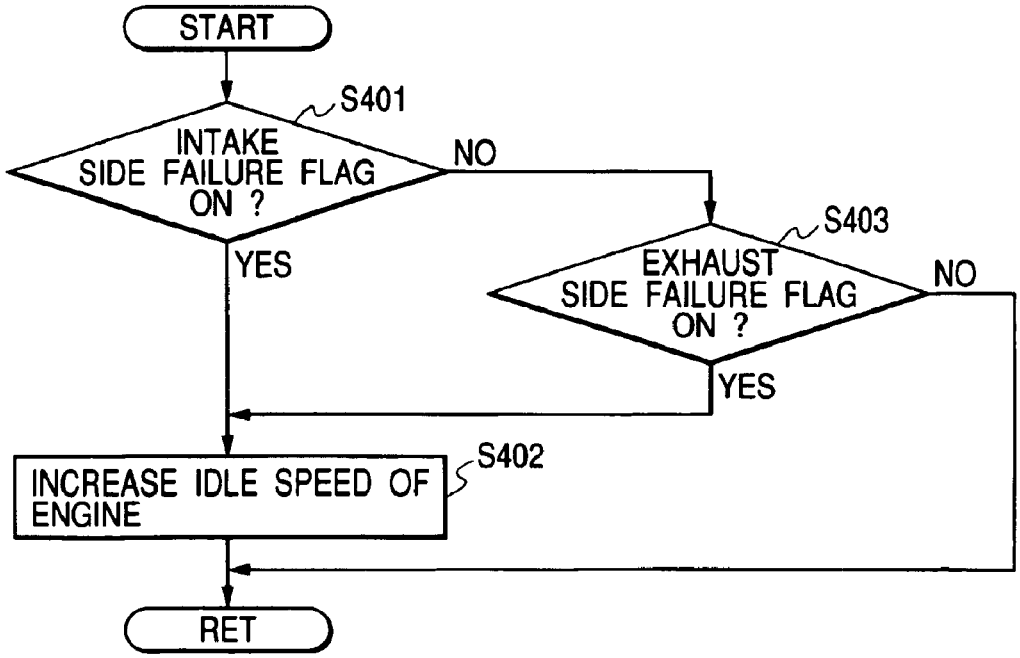
FIG. 5 is a flowchart of a modification of the program of FIG. 4.

FIG. 5 shows a modification of the valve timing control program executed by the ECU 30 at an interval of a given period of time which will be described below with reference to FIG. 6. In FIG. 6, a broken line indicates a change in idle speed of the engine 10 in a case where the control, as described below, is not carried out.

After entering the program, the routine proceeds to step 401 wherein it is determined whether the intake side failure flag, as provided in step 106 of FIG. 2, is in the on-state or not. If a YES answer is obtained meaning that the IN-VCT 50 has failed, so that the intake side failure flag is set to the on-state at time t1 in FIG. 6, then the routine proceeds to step 402 wherein a target idle speed of the engine 10 is increased more than usual and then terminates. For instance, the target idle speed is increased from 750 rmp up to 1500 rpm. The increase in idle speed of the engine serves to avoid rough idling of the engine 10 even if the amount of overlap between the opening and closing of the intake and exhaust valves is great. This improves the drivability of the engine 10.

Alternatively, if a NO answer is obtained in step 401 meaning that the IN-VCT 50 is in service, then the routine proceeds to step 403 wherein it is determined whether the exhaust side failure flag, as provided in step 206 of FIG. 3, is in the on-state or not. If a YES answer is obtained meaning that the EX-VCT 70 has failed, so that the exhaust side failure flag is set to the on-state, then the routine proceeds to step 402. Alternatively, if a NO answer is obtained meaning that the IN-VCT 50 and the EX-VCT 70 are both in service, then the routine terminates.

As apparent from the above, if a failure of either one of the IN-VCT 50 and the EX-VCT 70 has been detected, the valve timing control device of this modification increases the target idle speed of the engine 10, thereby reducing the rough idling of the engine 10 to improve the drivability in the low engine speed range.

The operations, as described in FIGS. 4 and 5, may be carried out simultaneously. Specifically, if a failure of one of the IN-VCT 50 and the EX-VCT 70 has occurred, the valve timing control device may work to actuate the other of the IN-VCT 50 and the EX-VCT 70 to decrease the amount of overlap between the opening and closing of the intake and exhaust valves of the engine 10 and also increase the idle speed of the engine 10, thereby reducing the rough idling of the engine 10 and improving the drivability of the vehicle.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments witch can be embodied without departing from the principle of the invention as set forth in the appended claims.

What is claimed is:

1. A valve timing control apparatus for an internal combustion engine comprising:

an intake side variable valve timing control mechanism installed in a driving force transmission system working to transmit a driving force outputted from a drive shaft of an internal combustion engine to a driven shaft working to open and close an intake valve of the engine, said intake side variable valve timing control mechanism being so designed as to control timing of opening and closing of the intake valve variably;

an exhaust side variable valve timing control mechanism installed in a driving force transmission system working to transmit the driving force outputted from the drive shaft of the engine to a driven shaft working to open and close an exhaust valve of the engine, said exhaust side variable valve timing control mechanism being so designed as to control timing of opening and closing of the exhaust valve variably; and a controller working to detect a failure in operation of each of said intake side variable valve timing control mechanism and said exhaust side variable valve timing control mechanism, the failure being a locking failure of at least one of the intake side variable valve timing control mechanism and the exhaust side variable valve timing control mechanism arising from intrusion of foreign matter into an oil supply system for at least one of the intake and exhaust side variable valve control mechanisms, if the locking failure of one of said intake side variable valve timing control mechanism and said exhaust side variable valve timing control mechanism is detected, said controller actuating the other of said intake side variable valve timing control mechanism and said exhaust side variable valve timing control mechanism to control the timing of opening and closing of a corresponding one of the intake and exhaust valves so as to decrease an amount of overlap between the opening and closing of the intake and exhaust valves;

wherein if the locking failure of one of said intake side variable valve timing control mechanism and said exhaust side variable valve timing control mechanism is detected, said controller also works to increase an idle speed of the engine.

2. A valve timing control apparatus as set forth in claim 1, wherein if the locking failure of one of said intake side variable valve timing control mechanism and said exhaust side variable valve timing control mechanism is detected, said controller minimizes the amount of overlap between the opening and closing of the intake and exhaust valves.

3. A method for valve timing control in an internal combustion engine, said method comprising:

monitoring intake valve timing and, in response to detecting a locking error in intake valve timing arising from intrusion of foreign matter into an oil supply system of an intake valve timing mechanism, actuating an exhaust valve timing control to decrease overlap time between opening and closing of intake and exhaust valves; and monitoring exhaust valve timing and, in response to detecting a locking error in exhaust valve timing arising from intrusion of foreign matter into an oil supply system of an exhaust valve timing mechanism, actuating an intake valve timing control to decrease overlap time between opening and closing of intake and exhaust valves;

increasing engine idle speed in response to detection of error in either intake or exhaust valve timing.

4. A method as in claim 3 wherein said decrease of overlap time minimizes such overlap time.

* * * * *